US008628358B2

(12) United States Patent
Tung et al.

(10) Patent No.: US 8,628,358 B2
(45) Date of Patent: Jan. 14, 2014

(54) ELECTRICAL CONNECTOR HAVING MOVABLE CENTRAL CONTACT

(75) Inventors: Chang-Hsien Tung, New Taipei (TW); Kuo-Chun Hsu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 306 days.

(21) Appl. No.: 13/088,432

(22) Filed: Apr. 18, 2011

(65) Prior Publication Data

US 2011/0256782 A1 Oct. 20, 2011

(51) Int. Cl.
*H01R 24/04* (2006.01)

(52) U.S. Cl.
USPC ..... 439/668; 439/700

(58) Field of Classification Search
USPC ..... 439/63, 188, 700, 581, 668
See application file for complete search history.

(56) References Cited

U.S. PATENT DOCUMENTS 4,564,730 A * 1/1986 Tomizu et al. ..... 200/16 B
5,133,676 A * 7/1992 Hutchison et al. ..... 439/581
5,230,641 A * 7/1993 Wharton ..... 439/668
5,248,259 A * 9/1993 Naito et al. ..... 439/34
5,626,485 A * 5/1997 Clyatt et al. ..... 439/188
5,649,840 A * 7/1997 Muto ..... 439/668
5,718,592 A * 2/1998 Hosler et al. ..... 439/63
6,224,407 B1 * 5/2001 Duquerroy et al. ..... 439/188
6,520,785 B2 * 2/2003 Hida ..... 439/188
6,712,628 B2 * 3/2004 Villain et al. ..... 439/188
6,758,680 B2 * 7/2004 Duquerroy et al. ..... 439/63
7,086,867 B2 * 8/2006 Nakagawa et al. ..... 439/63
7,094,112 B2 * 8/2006 Arai et al. ..... 439/700
7,632,121 B2 * 12/2009 Gonzales et al. ..... 439/188
7,789,697 B2 * 9/2010 Fiennes ..... 439/489
8,079,880 B2 * 12/2011 Lin et al. ..... 439/668
8,337,256 B1 * 12/2012 Lin ..... 439/700
8,360,801 B2 * 1/2013 Lynch et al. ..... 439/488
8,428,288 B2 * 4/2013 Lim ..... 381/384
2005/0048847 A1 3/2005 Hsieh

* cited by examiner

*Primary Examiner* — Neil Abrams
(74) *Attorney, Agent, or Firm* — Wei Te Chung; Ming Chieh Chang

(57) ABSTRACT

An electrical connector includes an insulative housing defining a mating cavity recessed from a front face towards a supporting face of a tongue portion arranged within the housing and a central contact arranged within the housing. The central contact includes a contacting part movably arranged in the tongue portion and having a mating portion extending beyond the supporting face, and a connecting part disposed within the housing and capable of intersecting with the contacting part at rear portion of the housing.

17 Claims, 13 Drawing Sheets

ELECTRICAL CONNECTOR HAVING MOVABLE CENTRAL CONTACT

BACKGROUND OF THE INVENTION

1. Field of the Invention

The present invention relates to an electrical connector, and more particular to a power jack having a central contact configured by a movable contacting part and a connecting part so as to reduce fracturing of solder joints of the power jack on a printed circuit board.

2. Description of the Related Art

US Pat. Pub No. 2005/0048847 submitted by Hsieh and published on Mar. 3, 2005 discloses a conventional power connector mainly including an insulative housing, a columnar central contact received in the housing and a soldering part fixed to the central contact. The housing defines a mating cavity recessed from a mating face thereof. The central contact is retained in a rear wall of the housing and provides a mating portion immovable relative to the housing and projecting into the mating cavity and a connecting portion extending out of the housing. The soldering part defines a base portion having a retaining hole at a middle portion thereof and a soldering portion for connecting with a printed circuit board, the retaining hole receives and retains the connecting portion therein to connect the mating portion to the printed board.

However, the soldering part is steadily fixed to the central contact and immovable relative to the central contact, and the connection between the soldering portion and the printed circuit board may be easily damaged by repeatedly mating and unmating thereof. Secondly, the immovable mating portion of the central contact may inadvertently enlarge the dimension of the electrical connector, which is not advantageous for miniaturization. Furthermore, when a mating connector is inserted into the mating cavity, users cannot determine whether the mating connector is completely inserted into the mating cavity or not. Therefore, an improved electrical connector is desired to overcome the above problems.

SUMMARY OF THE INVENTION

Accordingly, an object of the present invention is to provide an electrical connector having a contact configured with a movable contacting part moving to contact and deflect a connecting part to ensure reliable connection between the connecting part and a printed circuit board.

In order to achieve the object set forth, an electrical connector includes an insulative housing defining a mating cavity recessed from a front face towards a supporting face of a tongue portion arranged within the housing and a central contact arranged within the housing. The central contact includes a contacting part movably arranged in the tongue portion and having a mating portion extending beyond the supporting face, and a connecting part disposed within the housing and capable of intersecting with the contacting part at rear portion of the housing.

Other objects, advantages and novel features of the invention will become more apparent from the following detailed description of the present embodiment when taken in conjunction with the accompanying drawings.

DETAILED DESCRIPTION OF THE INVENTION

Figure 1:
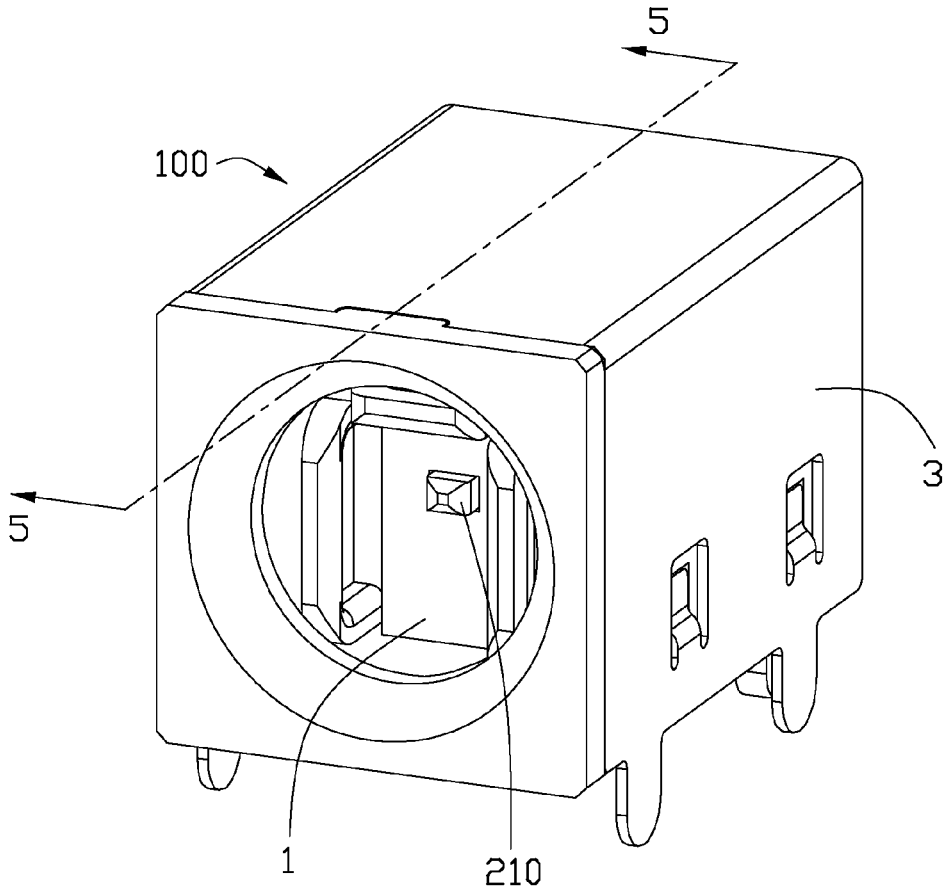
FIG. 1 is a perspective view of an electrical connector in accordance with a first embodiment of the present invention.
Figure 2:
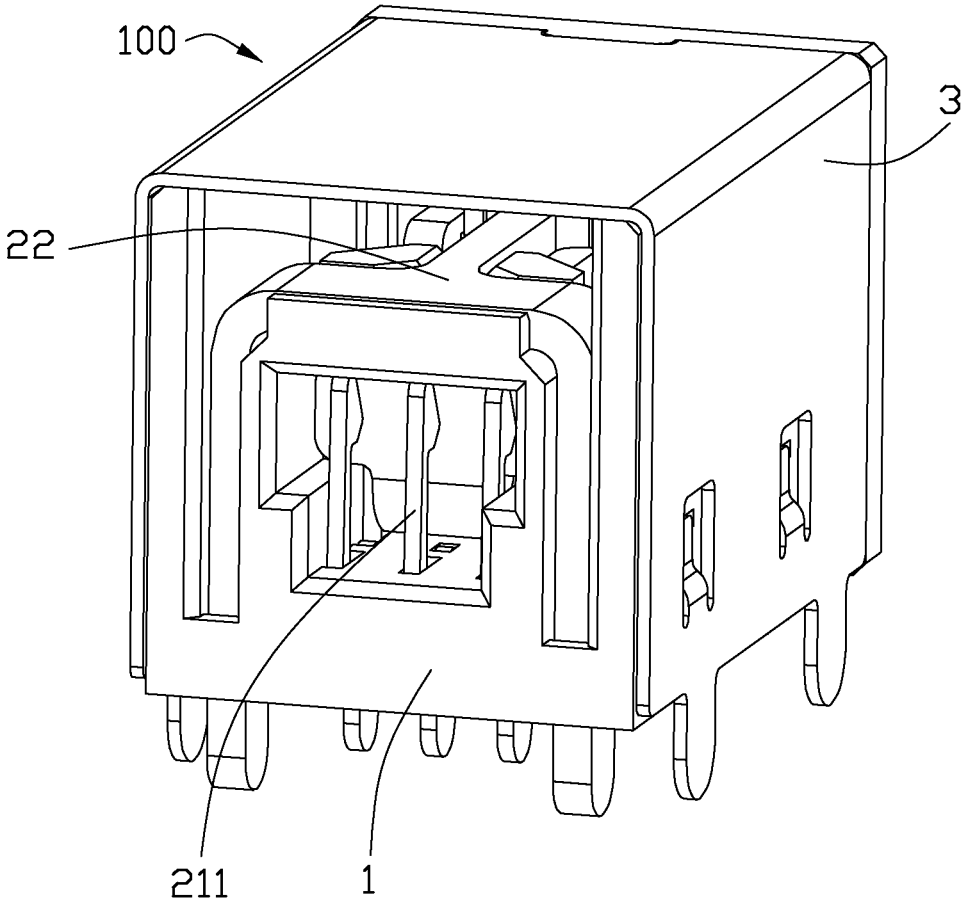
FIG. 2 is another perspective view of the electrical connector shown in FIG. 1.

Reference will now be made to the drawing figures to describe preferred embodiments of the present invention in detail.

Referring to FIG. 1 to FIG. 6, an electrical connector 100 made in accordance with a first embodiment of the present invention is provided. The electrical connector 100 defines an insulative housing 1, a central contact 21 and a first contact 22 retained in the housing 1 and a metal shell 3 enclosing the housing 1.

Figure 3:
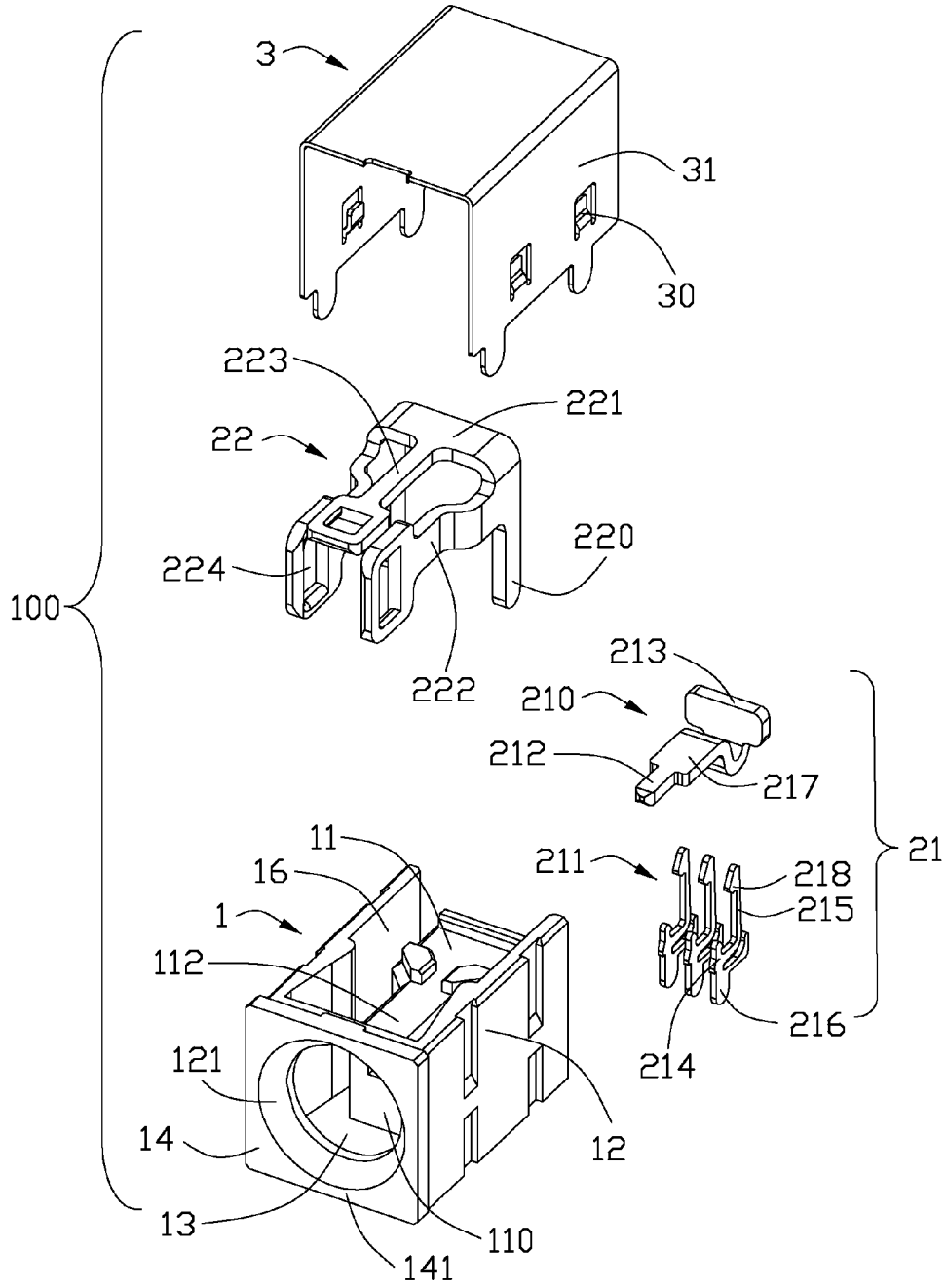
FIG. 3 is an exploded view of the electrical connector shown in FIG. 1.
Figure 4:
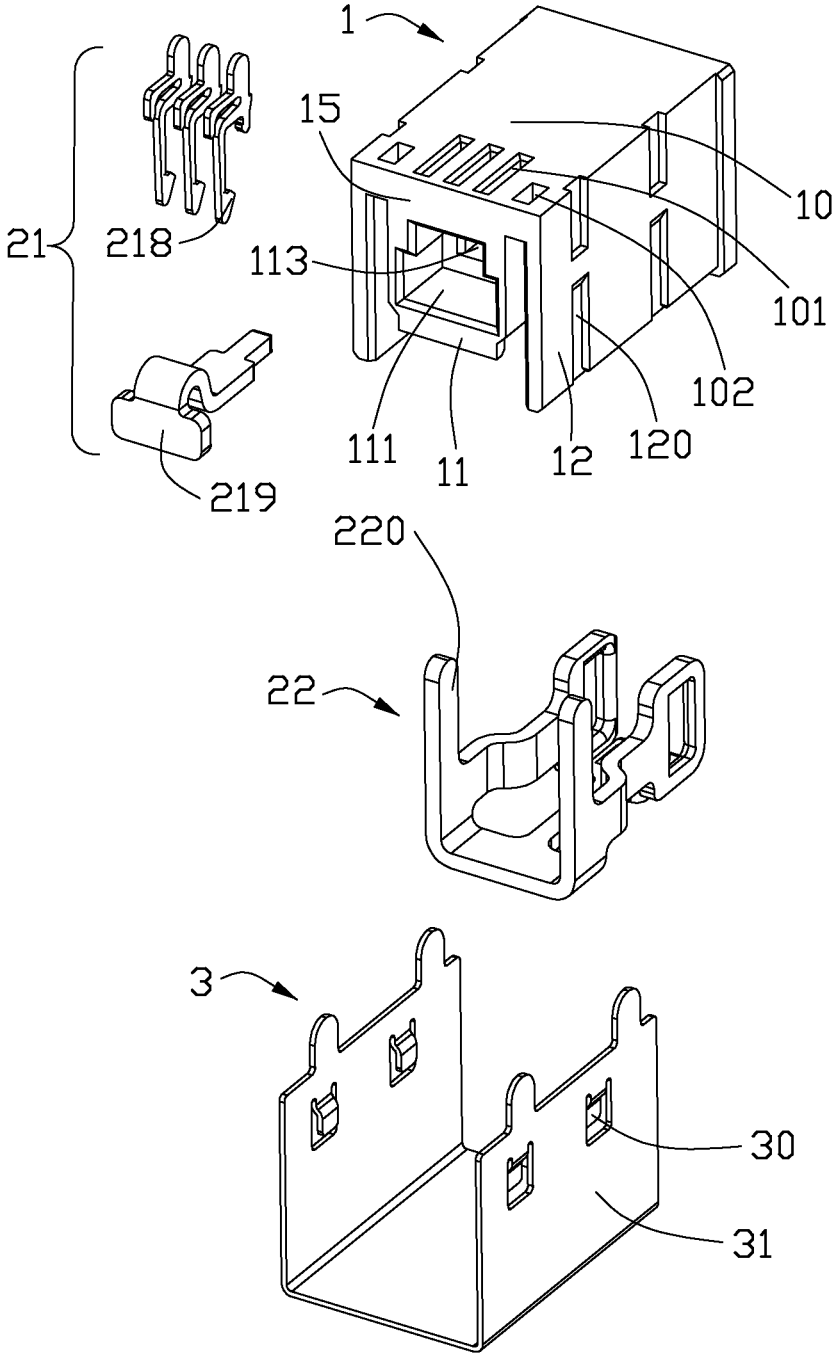
FIG. 4 is another exploded view of the electrical connector shown in FIG. 3.

Referring to FIG. 3 and FIG. 4, the housing 1 defines a bottom wall 10, a pair of sidewalls 12 oppositely and upwardly extending from the bottom wall 10, a front wall 14 connecting with the sidewalls 12 and the bottom wall 10, and a receiving room 16 defined by the pair of sidewalls 12, the bottom wall 10 and the front wall 14 commonly. The bottom wall 10 defines a longitudinal tongue portion 11 protruding upwardly into the receiving room 16 and peripherally surrounded by said sidewalls 12 and front wall 14. The tongue portion 11 defines a front face/supporting face 110, a rear face 15 opposite to the supporting face 110 and a top face 112 parallel to the bottom wall 10 and connecting the supporting face 110 with the rear face 15. The tongue portion 11 defines a receiving cavity 111 recessed from the rear face 15 thereof and a horizontal receiving groove 113 communicating with the receiving cavity 111 and forwardly extending along a mating direction to run through the supporting face 110. A mating cavity 13 for receiving a mating connector A is provided between a mating face 141 of the front wall 14 and the supporting face 110, and the mating cavity 13 provides a mating opening 121 at the mating face 141 thereof. The housing 1 provides three vertical retaining slots 101 running through the bottom wall 10 to communicate with the receiving cavity 111 and two retaining holes 102 respectively disposed at two outmost sides of the retaining slots 101 and communicating with the receiving room 16. The three retaining slots 101 align with each other along a transverse direction perpendicular to the mating direction and arranged in one row along the mating direction.

Referring to FIG. 3 to FIG. 6, the central contact 21 defines a contacting part 210 and three connecting parts 211 separated from the contacting part 210. The contacting part 210 defines a boar-shaped installing portion 217, a mating portion 212 extending forwardly from a front end of the installing portion 217 and a contacting portion 213 bending from a rear end of the installing portion 217. The contacting portion 213 is perpendicular to the installing portion 217 and the mating portion 212, and defines a contacting face 219 facing rearwards. The contacting part 210 is inserted into the housing 1 from the rear face 15 thereof, the installing portion 217 is received in the receiving groove 113, the mating portion 212 passes through the receiving groove 113 and extends beyond the supporting face 110 to enter into the mating cavity 13, and the contacting portion 213 is received in the receiving cavity 111. The contacting portion 213 may be blocked by a blocking portion 114 disposed in the receiving cavity 111 for preventing the contacting part 210 from moving forwards overly.

The three connecting parts 211 have similar configuration and each includes a retaining portion 214, a resilient arm 215 extending upwardly from the retaining portion 214 and a soldering portion 216 extending downwardly from the retaining portion 214. The resilient arm 215 defines a connecting portion 218 at a free end thereof. The connecting parts 211 are upwardly assembled to the housing 1 from the bottom wall 10 thereof, the retaining portions 214 are respectively retained in the corresponding retaining slots 101, the resilient arms 215 pass through the corresponding retaining slots 101 and project into the receiving cavity 111, and the soldering portions 216 extend out of the housing 1. The contacting part 210 is located at a first position in which the mating connector A disconnects with the mating portion 212, and the resilient arms 215 are disposed behind the contacting portion 213, and the contacting face 219 faces to the connecting portions 218 and contacts with the connecting portions 218. The three connecting portions 218 align with each other and are arranged in one row along the mating direction, and the resilient arms 215 may prevent the contacting part 210 from moving rearwards overly.

The contacting part 210 may move rearwards along the mating direction from the first position to resist the resilient arms 215 and deflect the resilient arms 215 rearwards when the mating connector A is inserted into the mating cavity 13, which can reduce the impact to the soldering portions 216 during the mating portion 212 mating with the mating connector A, and the connection between the soldering portions 216 and a printed circuit board can be protected. The contacting part 210 will locate at a second position in which the mating connector A is completely inserted into the mating cavity 13, and the resilient arms 215 will revert to push the contacting part 210 moving forwardly from the second position back to the first position when the mating connector is pulled out of the mating cavity 13. The contacting part 210 capable of moving along the mating direction relative to the housing 1 between the first position and the second position can reduce the dimension of the mating portion 212 disposed in the mating cavity 13, which is advantageous for miniaturization. The movable contacting part 210 moves to contact with the three connecting parts 211 to transfer power signal, and the central contact 21 acts as a power contact for the electrical connector 100.

Figure 5:
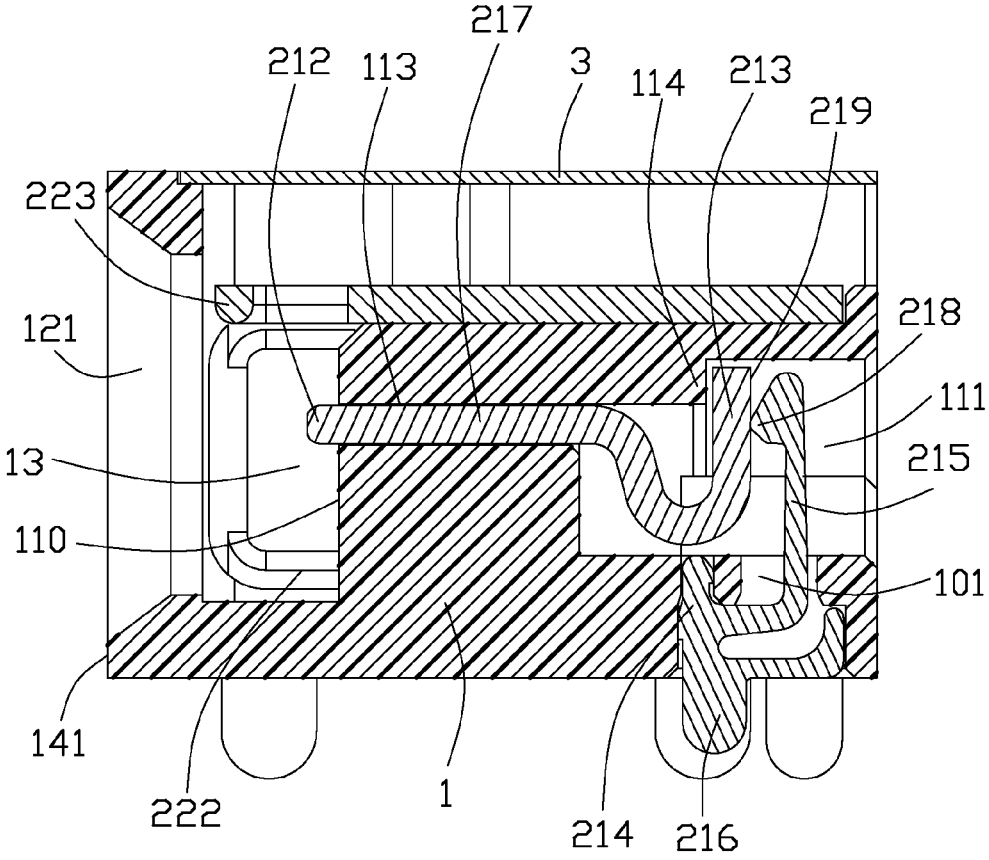
FIG. 5 is a cross sectional view taken along line 5-5 of FIG. 1, showing a contacting part of the electrical connector located at a first position.
Figure 6:
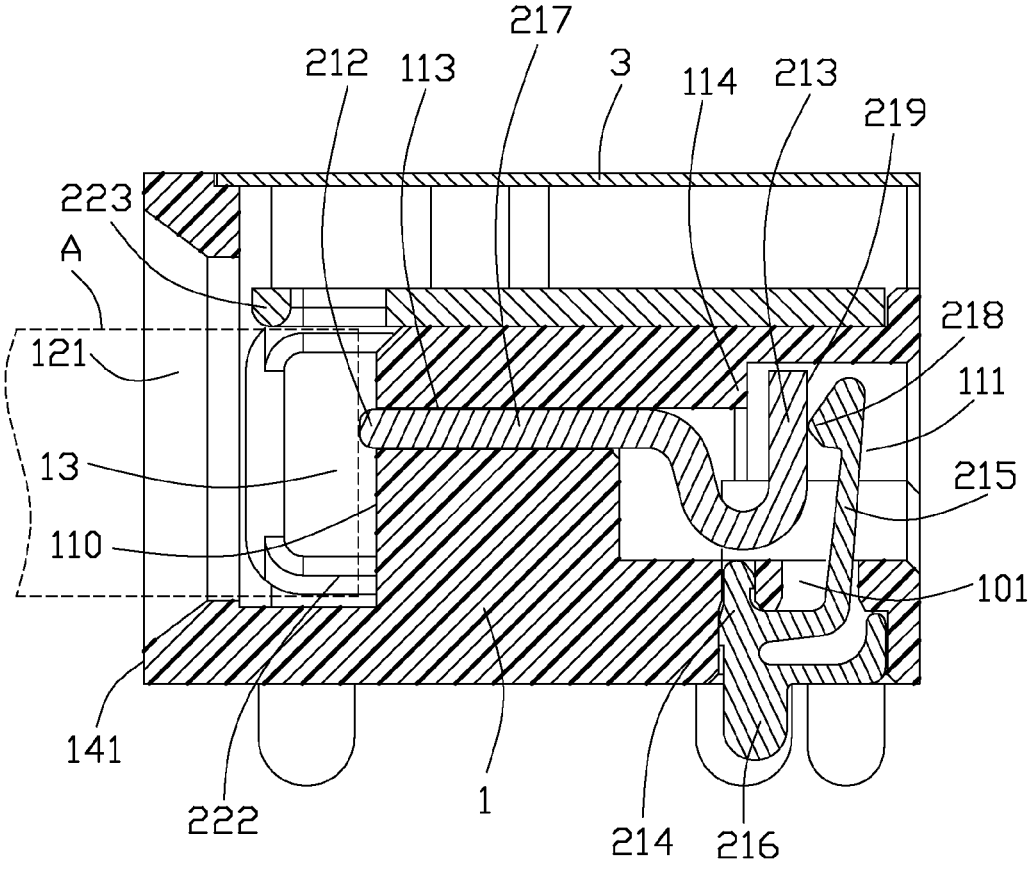
FIG. 6 is a view of a mating connector completely inserted into a mating cavity of the electrical connector shown in FIG. 5, showing the contacting part located at a second position.

Referring to FIG. 3 to FIG. 5, the first contact 22 defines a U-shaped base portion 221, a pair of first latching arms 222 oppositely extending from two vertical side pieces of the base portion 221, a second latching arm 223 extending from a top piece connecting with the side pieces of the base portion 221, and two soldering portions 220 oppositely extending from the side pieces. The first and second latching arms 222, 223 are disposed in front of the base portion 221, and each defines a window portion 224 at a free end thereof for latching with the mating connector. The first contact 22 is downwardly assembled to the housing 1 with the base portion 221 riding on the tongue portion 11, the first latching arms 222 disposed at two sides of the tongue portion 11 and extends into the mating cavity 13, the second latching arm 223 attaches to the top face 112 and extends along the top face 112 to enter into the mating cavity 13, the soldering portions 220 run through the corresponding retaining holes 102. The first contact 22 acts as a grounding contact for the electrical connector 100. The shell 3 is downwardly assembled to the housing 1 and retained to housing 1 by elastic pieces 30 punched from opposite side boards 31 latching with corresponding latching slots 120 disposed at an outer surface of each sidewall 12.

Figure 7:
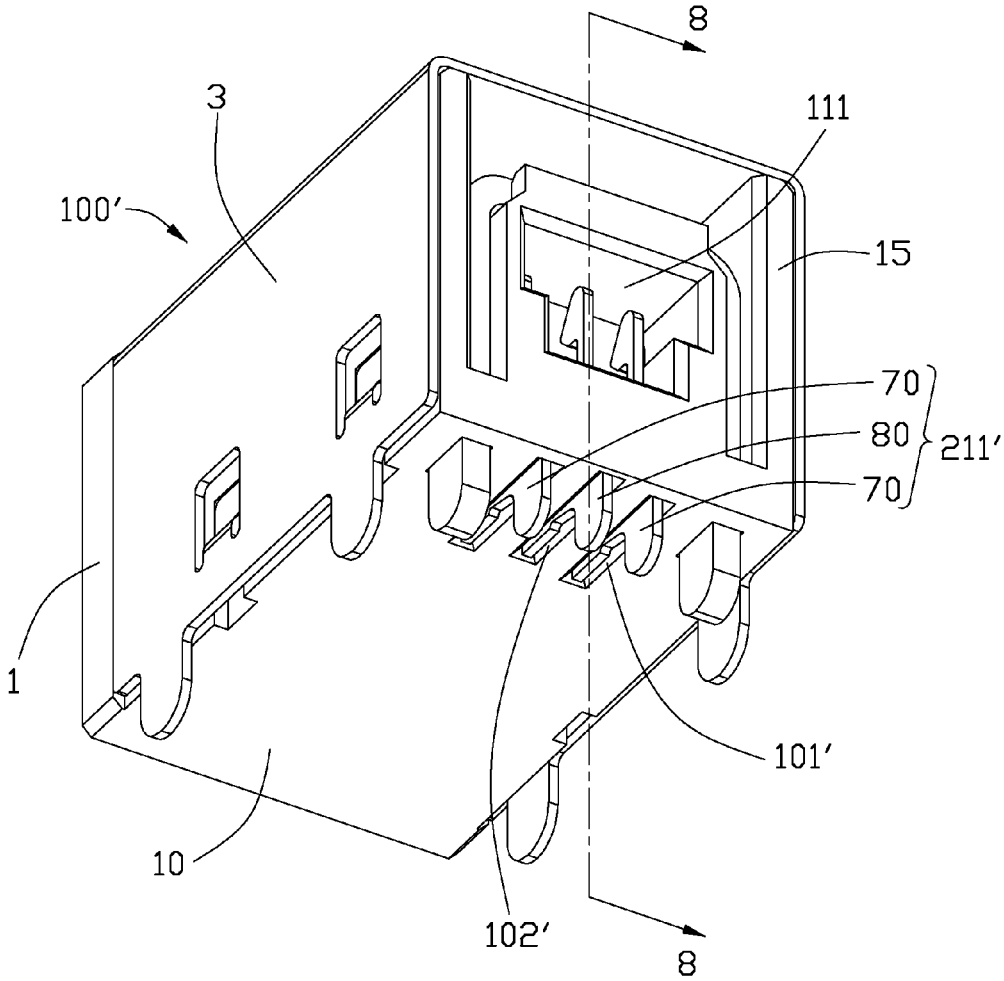
FIG. 7 is a perspective view of an electrical connector in accordance with a second embodiment of the present invention.
Figure 8:
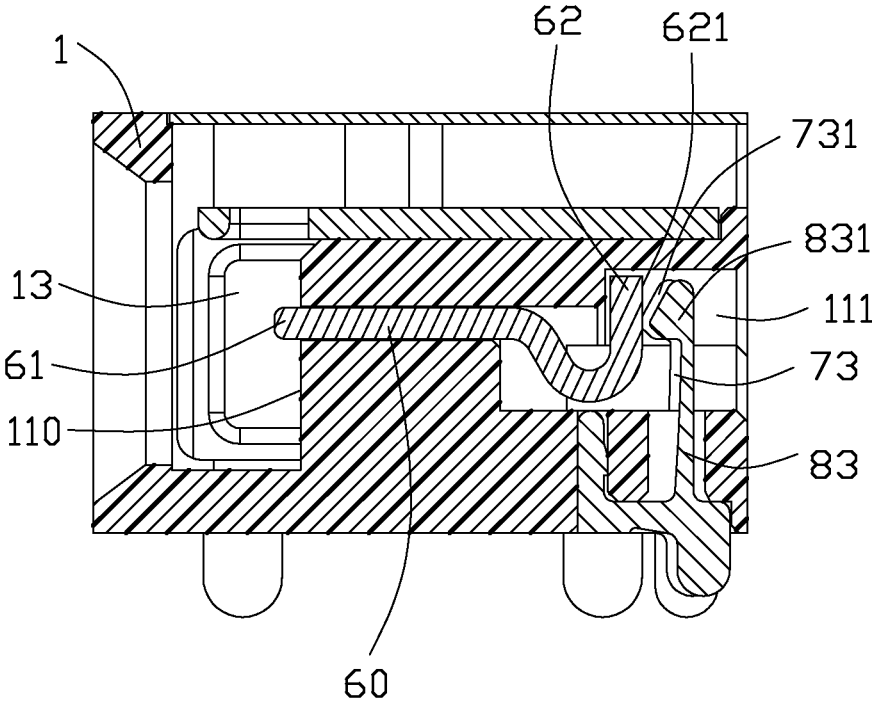
FIG. 8 is a cross sectional view taken along line 7-7 of FIG. 7, showing a contacting part of the electrical connector located at a first position.
Figure 9:
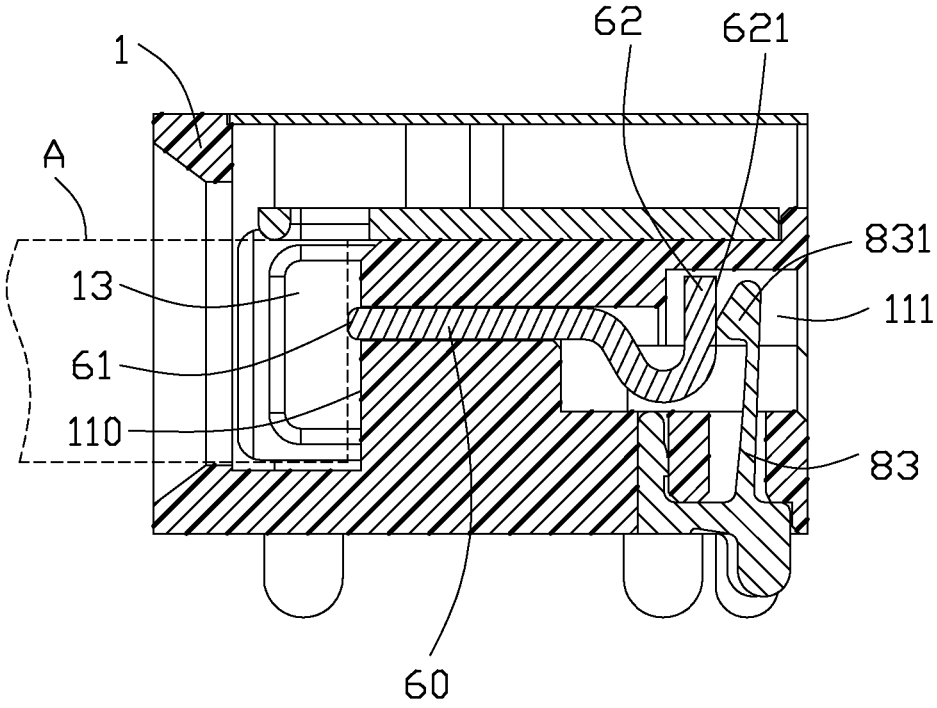
FIG. 9 is a view of a mating connector completely inserted into a mating cavity of the electrical connector shown in FIG. 8, showing the contacting part located at a second position.
Figure 10:
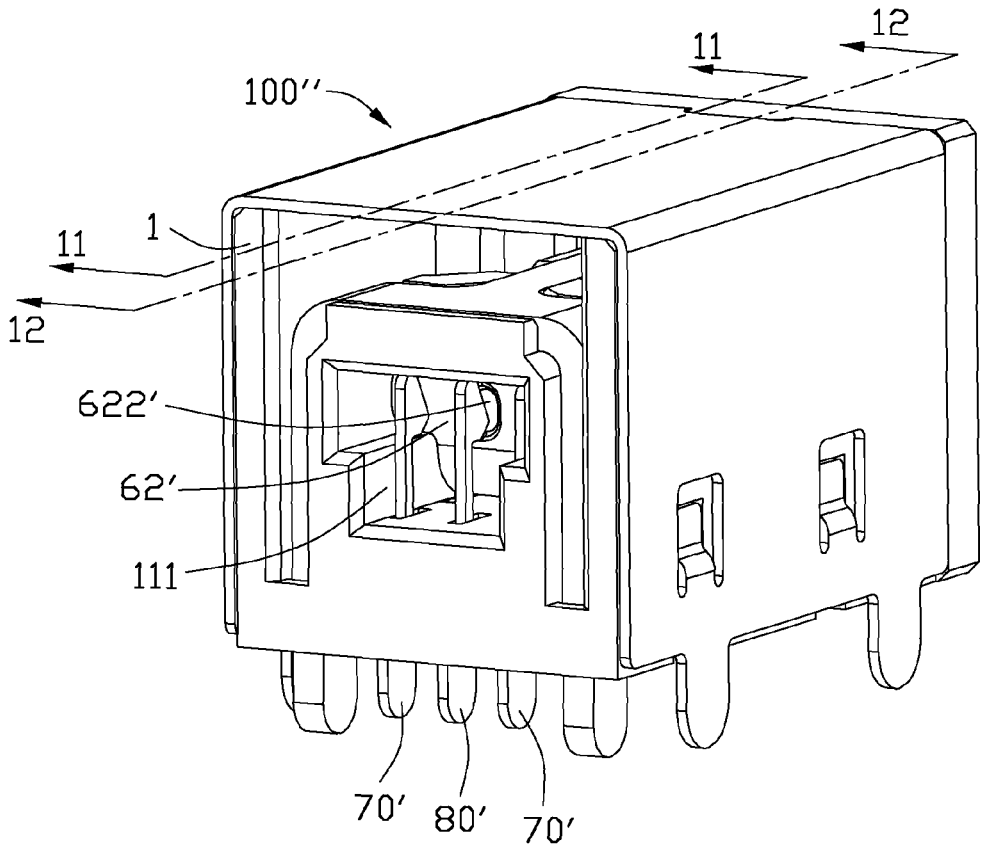
FIG. 10 is a perspective view of an electrical connector in accordance with a third embodiment of the present invention.
Figure 11:
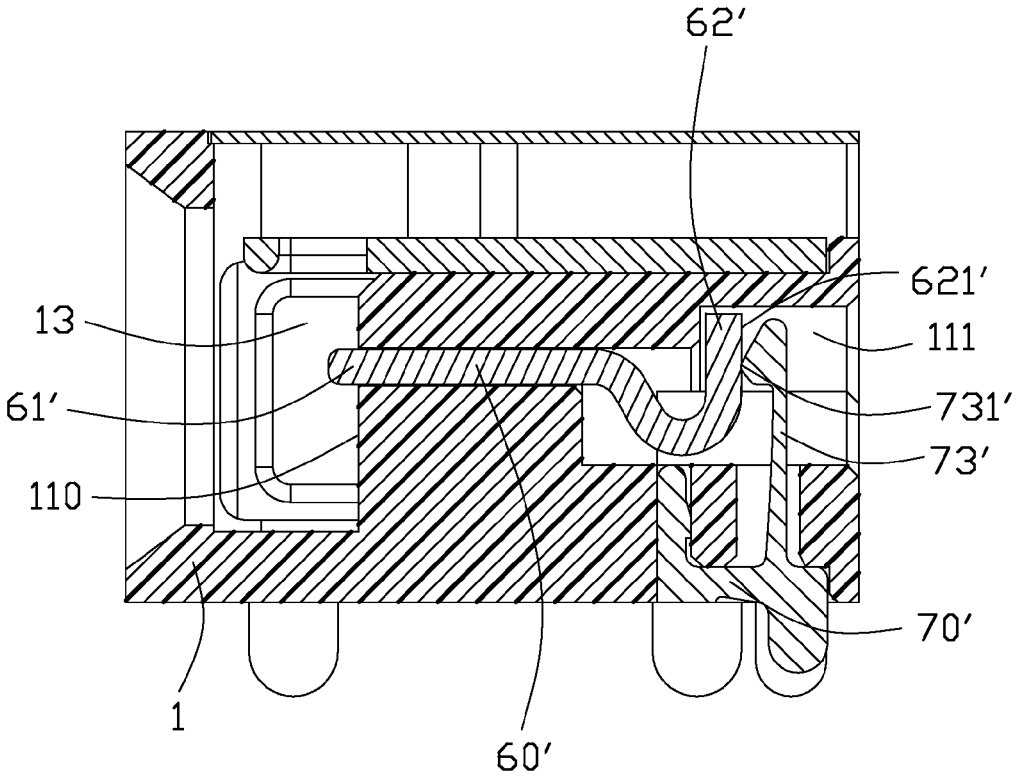
FIG. 11 is a cross sectional view taken along line 11-11 of FIG. 10, showing a contacting part of the electrical connector located at a first position.
Figure 12:
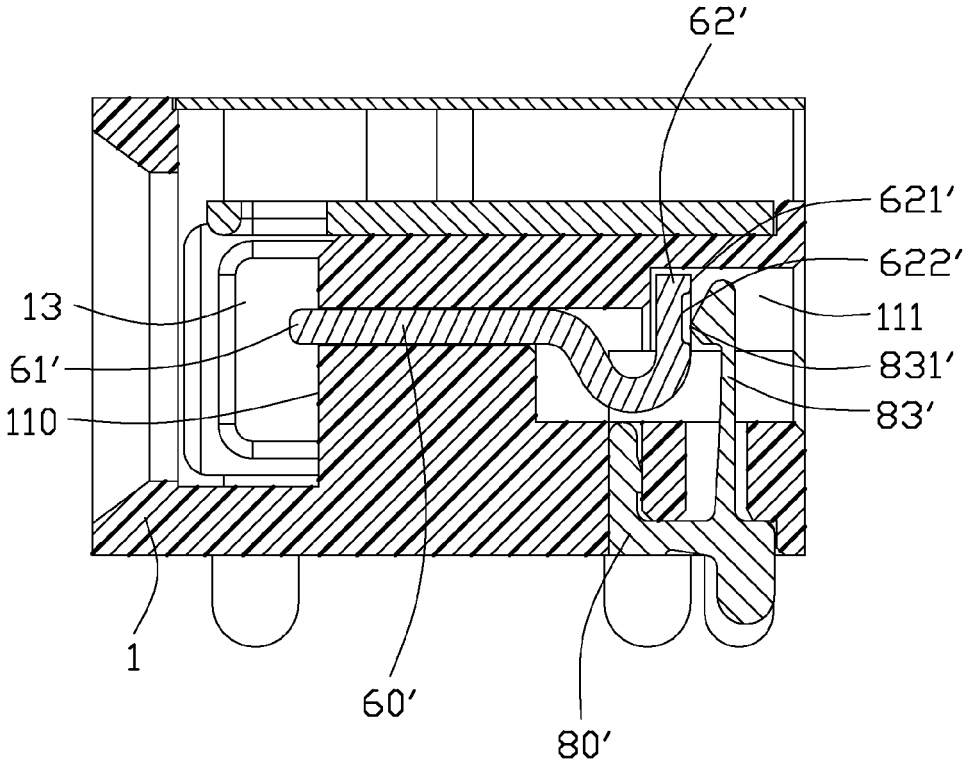
FIG. 12 is a cross sectional view taken along line 12-12 of FIG. 10, showing the contacting part located at the first position.
Figure 13:
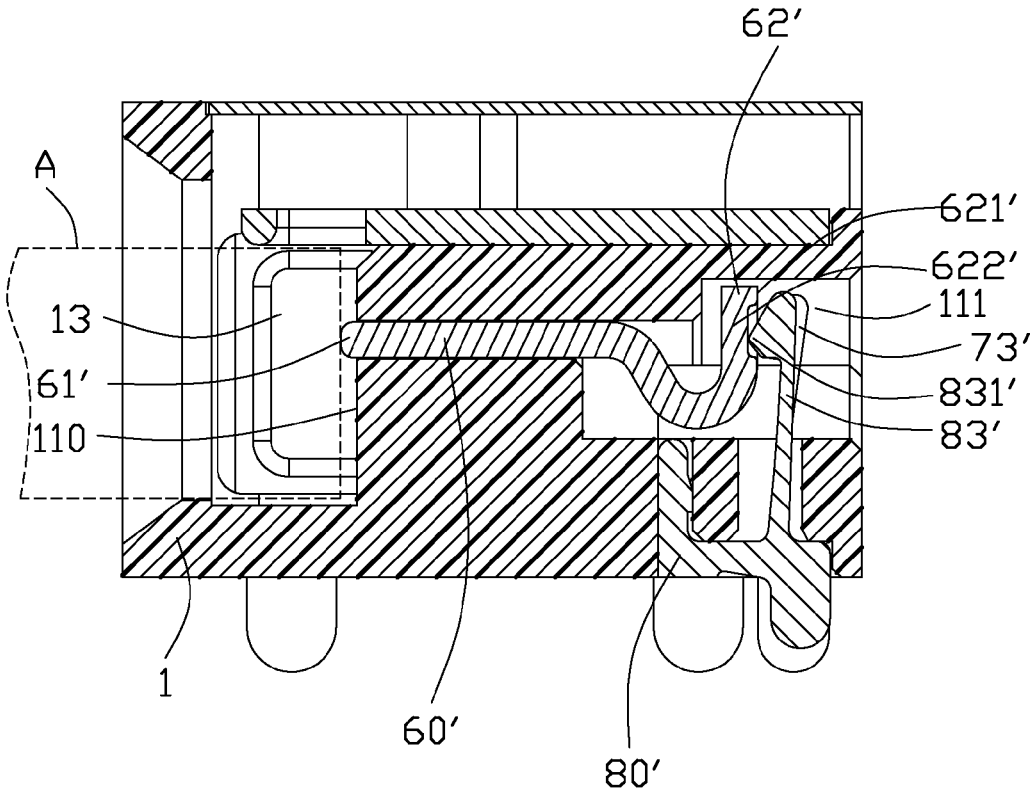
FIG. 13 is a view of a mating connector completely inserted into a mating cavity of the electrical connector shown in FIG. 12, showing the contacting part located at a second position.

FIG. 7 to FIG. 9 shows an improved electrical connector 100' in accordance with a second embodiment of the present invention. The electrical connector 100' has similar configuration as the electrical connector 100 mentioned in the first embodiment except that the three retaining slots 101', 102' are arranged in two rows along the mating direction. The middle retaining slot 102' offsets with other two side retaining slots 101' along the transverse direction and is closer to the rear face 15 of the housing 1. The contacting part 60 is movably assembled to the housing 1 with the mating portion 61 extending beyond the supporting face 110 and disposed in the mating cavity 13. The three connecting parts 211' include a middle connecting part 80 retained in the middle retaining slots 102' and provided as a detecting part, and other two side connecting parts 70 disposed at two sides of the detecting part 80 and retained in the side retaining slots 101'. The detecting part 80 and the two side connecting parts 70 have similar configuration. The detecting part 80 provides a resilient arm 83 projecting into the receiving cavity 111, and the resilient arm 83 defines a connecting portion 831 at a free end thereof for contacting with the contacting face 621 of the contacting portion 62. Each of the two side connecting parts 70 defines a resilient arm 73 projecting into the receiving cavity 111 and defining a connecting portion 731 at a free end thereof. The connecting portions 731 of the two side connecting parts 70 and the connecting portion 831 of the detecting part 80 are arranged in two rows along the mating direction, and the connecting portion 831 offsets with the two connecting portions 731 along the transverse direction. When the contacting part 60 locates at the first position, the resilient arms 73 are rested with the connecting portions 731 contacting with the contacting face 621 and the connecting portion 831 of the detecting part 80 spaced from the contacting face 621. The contacting part 60 may be pushed to move towards the second position along the mating direction to deflect the resilient arms 73 rearwards until the contacting portion 62 contacts with the connecting portion 831, in which the mating connector A is completely inserted into the mating cavity 13 and the contacting part 60 is located at the second position. The resilient arms 73 of the two side connecting parts 70 align with the resilient arm 83 of the detecting part 80 when the contacting part 60 disposed at the second position. The resilient arms 73 will revert to drive the contacting part 60 move from the second position to the first position to disconnect the connection between the contacting portion 62 and the connecting portion 831. The connecting portion 831 spaced from the contacting portion 62 will contact with the contacting portion 62 when the contacting part 60 locates at the second position, which provides a detective function for the electrical connector 100'. The contacting part 60 connects with the two side connecting parts 70 for transferring power signal for the electrical connector 100'.

FIG. 10 to FIG. 13 shows an improved electrical connector 100" having a detective function in accordance with a third embodiment of the present invention. The electrical connector 100" has similar configuration as the electrical connector 100 mentioned in the first embodiment except that the contacting portion 62' defines a receiving slot 622' recessed from a middle portion of the contacting face 621' thereof. The contacting part 60' is movably assembled to the housing 1 with the mating portion 61' extending beyond the supporting face 110 and disposed in the mating cavity 13. The two side connecting parts 70' each defines a resilient arm 73' projecting into the receiving cavity 111 and having a connecting portion 731' at a free end thereof, and the detecting part 80' provides a resilient arm 83' disposed in the receiving cavity 111 and having a connecting portion 831' at a free end thereof. The connecting portions 731' of the two side connecting parts 70' align with the connecting portion 831' of the detecting part 80', and the three connecting portions 731', 831' are arranged in one row along the mating direction. When the contacting part 60' locates at the first position, the connecting portions 731' of the two side connecting parts 70' contact with the contacting face 621', and the connecting portion 831' of the detecting part 80' faces to the receiving slot 622' and is spaced from the contacting face 621'. The contacting part 60' may be pushed to move from the first position to the second position along the mating direction to deflect the resilient arms 73' rearwards until the connecting portion 831' is received in the receiving slot 622' and contact with the contacting portion 62', in which the mating connector A is completely inserted into the mating cavity 13 and the contacting part 60' locates at the second position. The resilient arms 73' will revert to drive the contacting part 60' move forwardly to disconnect the connection between the contacting portion 62' and the connecting portion 831' when the mating connector A is pulled out of the mating cavity 13. The connecting portion 831' spaced from the contacting portion 62' will contact with the contacting portion 62' when the contacting part 60' locates at the second position, which may provide a detective function for the electrical connector 100". The contacting part 60' connects with the two side connecting parts 70' for transferring power signal for the electrical connector 100".

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a horizontal receiving groove and two vertical retaining slots;

a contacting part disposed within the horizontal receiving groove and capable of moving along a mating direction relative to the housing between a first position and a second position;

a connecting part disposed within one of the vertical retaining slots biasing the first contact at least at the second position; and a detecting part retained in the other vertical retaining slot to contact the contacting part located at the second position.

2. The electrical connector as described in claim 1, wherein the connecting part biases the contacting part between the first position and the second position.

3. The electrical connector as described in claim 2, wherein the contacting part contacts with the connecting part and disconnects with the detecting part when the contacting part is located at the first position.

4. The electrical connector as described in claim 3, wherein the connecting part and the detecting part each defines a connecting portion facing to a contacting portion extending from the contacting part thereof, and the connecting portion of the connecting part and the connecting portion of the detecting part are arranged in different rows along the mating direction.

5. The electrical connector as described in claim 3, wherein, the connecting part and the detecting part each defines a connecting portion opposite to a contacting portion extending from the contacting part thereof, and the contacting portion defines a receiving slot facing to the connecting portion of the detecting part.

6. The electrical connector as described in claim 1, wherein the housing defines a bottom wall, a mating face connecting with the bottom wall and a tongue portion projecting from the bottom wall, the tongue portion provides a supporting face opposite to the mating face, and the contacting part is assembled to the tongue portion with a mating portion disposed in a mating cavity provided between the supporting face and the mating face.

7. The electrical connector as described in claim 6, further defining a first contact having a latching arm thereof, the first contact rides on the tongue portion with the latching arm extending into the mating cavity.

8. An electrical connector comprising:

an insulative housing;

a contacting part movably assembled to the housing; and a connecting part retained in the housing and separated from the contacting part;

wherein the contacting part defines a contacting portion capable of moving along a mating direction relative to the housing to electrically interconnect and deflect a resilient arm extending from the connecting part thereof;

wherein the contact part, which is forwardly urged only by the resilient arm, is configured relatively stiffer than the resilient arm so as to experience less deflection than the resilient arm.

9. The electrical connector as described in claim 8, wherein the housing defines a mating cavity recessed from a mating face thereof and a receiving cavity recessed from a rear face facing to the mating face and communicating with the mating cavity, the contacting part is assembled to the housing with a mating portion disposed in the mating cavity and the contacting portion received in the receiving cavity.

10. The electrical connector as described in claim 9, wherein the resilient arm is received in the receiving cavity and disposed behind the contacting portion along the mating direction.

11. The electrical connector as described in claim 10, further defining a detecting part received in the receiving cavity thereof, the contacting portion contacts with the resilient arm and disconnects with the detecting part when the resilient arm is rested.

12. The electrical connector as described in claim 11, further defining a first contact having a latching arm thereof, the first contact rides on a tongue portion projecting from the housing for receiving the contacting part therein with the latching arm extending into the mating cavity.

13. The electrical connector as described in claim 8, wherein the connecting part defines a tail for mounting to a printed circuit board, the housing and the contacting part are configured to allow the contacting part to be assembled to the housing along the mating direction while the housing and the connecting part are configured to allow the connecting part to be assembled to the housing in a vertical direction perpendicular to said mating direction.

14. An electrical connector comprising:

an insulative housing;

a contacting part movably assembled to the housing; and a connecting part retained in the housing and separated from the contacting part;

wherein the contacting part defines a contacting portion capable of moving along a mating direction relative to the housing to electrically interconnect and deflect a resilient arm extending from the connecting part thereof;

wherein said connecting part includes at least first and second pieces each having the resilient arm and a corresponding tail for mounting to a printed circuit board under condition that the resilient arm of the first piece constantly abuts against the contacting part while the resilient arm of the second piece abuts against the contacting part only when the contacting part is moved to a rear position in said mating direction but not when the contacting part is moved to a front position in said mating direction.

15. The electrical connector as described in claim 14, wherein the resilient arm of the first piece is closer to the contacting part than the resilient arm of the second piece.

16. The electrical connector as described in claim 14, wherein the resilient arm of the first piece and the resilient arm of the second piece are arranged in one row perpendicular to the mating direction, and the contacting part defines a receiving slot facing to the resilient arm of the second piece.

17. The electrical connector as described in claim 8, wherein the contacting portion is linked at a rear end portion of the contacting part via a curved structure for providing resiliency thereof.

* * * * *